US007883261B2

(12) United States Patent
Yu

(10) Patent No.: US 7,883,261 B2
(45) Date of Patent: Feb. 8, 2011

(54) WATER-RESISTANT AND REPLACEABLE LED LAMPS

(75) Inventor: Jing Jing Yu, El Monte, CA (US)

(73) Assignee: 1 Energy Solutions, Inc., El Monte, CA (US)

( * ) Notice: Subject to any disclaimer, the term of this patent is extended or adjusted under 35 U.S.C. 154(b) by 248 days.

(21) Appl. No.: 12/254,787

(22) Filed: Oct. 20, 2008

(65) Prior Publication Data

US 2009/0251923 A1 Oct. 8, 2009

Related U.S. Application Data

(60) Provisional application No. 61/043,262, filed on Apr. 8, 2008.

(51) Int. Cl.
*H01R 33/00* (2006.01)

(52) U.S. Cl. ..... 362/652; 362/653; 362/654; 362/655; 362/657; 362/249.06; 362/249.02; 439/619; 439/699.2; 439/699.1

(58) Field of Classification Search ..... 362/652–659, 362/249.02, 249.06, 249.14, 249.16; 439/619, 439/699.1, 699.2
See application file for complete search history.

(56) References Cited

U.S. PATENT DOCUMENTS

| | | | | |
|---|---|---|---|---|
| 1,694,997 | A | | 12/1928 | VanHorn |
| 3,425,027 | A | * | 1/1969 | Uberbacher et al. ..... 439/619 |
| 3,519,913 | A | | 7/1970 | Janecek |
| 3,593,038 | A | | 7/1971 | Hylten-Cavallius |
| 3,639,822 | A | | 2/1972 | Brown |
| 3,758,771 | A | | 9/1973 | Frohardt |
| 4,035,681 | A | | 7/1977 | Savage |
| 4,074,165 | A | | 2/1978 | Moriyama |
| 4,223,248 | A | | 9/1980 | Tong |
| 4,298,869 | A | | 11/1981 | Okuno |
| 4,316,125 | A | | 2/1982 | Noguchi |
| 4,321,598 | A | | 3/1982 | Warner |
| 4,329,625 | A | | 5/1982 | Nishizawa |
| 4,348,663 | A | | 9/1982 | Yanagishima |
| 4,365,244 | A | | 12/1982 | Gillessen |
| 4,367,471 | A | | 1/1983 | Gillessen |
| 4,396,823 | A | | 8/1983 | Nihei |

(Continued)

FOREIGN PATENT DOCUMENTS

| | | |
|---|---|---|
| CA | 2342321 | 3/2000 |

OTHER PUBLICATIONS

U.S. Appl. No. 12/099,034, filed Apr. 7, 2008, by Jing Jing Yu.

(Continued)

*Primary Examiner*—Jong-Suk (James) Lee
*Assistant Examiner*—Robert J May
(74) *Attorney, Agent, or Firm*—William W. Cochran; Cochran Freund & Young LLC

(57) ABSTRACT

Disclosed is waterproof lamp assembly that allows easy assembly and disassembly. LED elements can be quickly and easily replaced if an LED element is defective or burns out. Extended connectors are used that extend beyond an over-molded lamp holder so that the lamp holder can be easily molded without covering the connectors with molding material. The connectors are made from a malleable metal so that the connectors can be folded into a central opening in the lamp holder.

9 Claims, 6 Drawing Sheets

U.S. PATENT DOCUMENTS 4,492,952 A 1/1985 Miller
4,521,835 A 6/1985 Meggs
4,528,619 A 7/1985 Dolan
4,595,920 A 6/1986 Runyan
4,652,981 A 3/1987 Glynn
4,675,575 A 6/1987 Smith
4,727,603 A 3/1988 Howard
4,807,098 A 2/1989 Ahroni
4,839,777 A 6/1989 Janko
4,843,280 A 6/1989 Lumbard
4,857,920 A 8/1989 Kataoka
4,954,822 A 9/1990 Borenstein
4,959,766 A 9/1990 Jain
4,967,330 A 10/1990 Bell et al.
5,087,212 A 2/1992 Hanami
5,130,897 A 7/1992 Kuzma
5,155,669 A 10/1992 Yamuro
5,187,377 A 2/1993 Katoh
5,193,895 A 3/1993 Naruke
5,257,020 A 10/1993 Morse
5,313,187 A 5/1994 Choi
5,321,593 A 6/1994 Moates
5,323,305 A 6/1994 Ikeda
5,366,780 A 11/1994 Rapisarda
5,404,282 A 4/1995 Klinke
5,410,458 A 4/1995 Bell
5,436,809 A 7/1995 Brassier
5,457,450 A 10/1995 Deese
5,463,280 A 10/1995 Johnson
5,481,444 A 1/1996 Schultz
5,499,174 A 3/1996 Lin
5,528,484 A 6/1996 Hayashi
5,567,037 A 10/1996 Ferber
5,580,159 A 12/1996 Liu
5,647,759 A 7/1997 Lien
5,649,755 A 7/1997 Rapisarda
5,655,830 A 8/1997 Ruskouski
5,660,560 A 8/1997 Chong
5,663,719 A 9/1997 Deese
5,670,847 A 9/1997 Lin
5,672,000 A 9/1997 Lin
5,681,107 A 10/1997 Wang
5,720,544 A 2/1998 Shu
5,722,860 A 3/1998 Pan
5,726,535 A 3/1998 Yan
5,762,419 A 6/1998 Yan
5,808,592 A 9/1998 Mizutani
5,887,967 A 3/1999 Chang
5,890,794 A 4/1999 Abtahi
5,936,599 A 8/1999 Raymond
5,941,626 A 8/1999 Yamuro
5,962,971 A 10/1999 Chen
5,988,831 A 11/1999 Pan
6,048,074 A 4/2000 Wang
6,072,280 A 6/2000 Allen
6,079,848 A 6/2000 Ahroni
6,120,312 A 9/2000 Shu
6,183,104 B1 2/2001 Ferrara
6,183,310 B1 2/2001 Shu
6,190,021 B1 2/2001 Huang
6,200,003 B1 3/2001 Tseng
6,227,679 B1 5/2001 Zhang
6,283,797 B1 9/2001 Wu
6,361,198 B1 3/2002 Reed
6,367,952 B1 4/2002 Gibboney
6,382,812 B1 * 5/2002 Hsu ..... 362/249.07
6,461,019 B1 10/2002 Allen
6,478,455 B2 11/2002 Ahroni
6,505,954 B2 1/2003 Chen
6,550,953 B1 4/2003 Ichikawa
D474,848 S 5/2003 Lodhie
D474,879 S 5/2003 Lodhie
6,598,996 B1 7/2003 Lodhie
D485,379 S 1/2004 Steklenburg
6,709,132 B2 3/2004 Ishibashi
6,717,526 B2 4/2004 Martineau
6,739,733 B1 5/2004 Lamke et al.
6,758,578 B1 7/2004 Chou
6,830,358 B2 12/2004 Allen
7,012,379 B1 3/2006 Chambers et al.
7,014,352 B2 3/2006 Wu
7,045,965 B2 5/2006 Yu
7,063,442 B2 6/2006 Sugar
7,066,628 B2 6/2006 Allen
7,066,636 B2 6/2006 Wu
7,118,249 B2 10/2006 Hsu et al.
7,217,005 B2 5/2007 Lin
7,220,022 B2 5/2007 Allen et al.
2002/0043943 A1 4/2002 Menzer et al.
2002/0105438 A1 8/2002 Forbes
2003/0025120 A1 2/2003 Chang
2003/0079387 A1 5/2003 Derose
2003/0147245 A1 8/2003 Chen
2003/0198048 A1 10/2003 Frederick
2004/0135522 A1 7/2004 Berman
2004/0140892 A1 7/2004 Hanood
2004/0190289 A1 9/2004 Liu
2004/0190290 A1 9/2004 Zerphy et al.
2004/0233145 A1 11/2004 Chiang
2005/0057187 A1 3/2005 Catalano
2005/0162851 A1 7/2005 Kazar et al.
2006/0007679 A1 1/2006 Allen
2006/0012349 A1 1/2006 Allen
2006/0012997 A1 1/2006 Catalano
2006/0044788 A1 3/2006 Damrau
2006/0098442 A1 5/2006 Yu
2006/0180822 A1 8/2006 Yu
2006/0203482 A1 9/2006 Allen
2006/0256585 A1 * 11/2006 Pan ..... 362/653
2006/0270250 A1 11/2006 Allen
2007/0025109 A1 2/2007 Yu
2007/0064450 A1 3/2007 Chiba et al.
2007/0183153 A1 8/2007 Yu
2008/0013324 A1 1/2008 Yu
2008/0024071 A1 1/2008 Yu
2008/0025024 A1 1/2008 Yu
2008/0143234 A1 6/2008 Yu
2008/0157686 A1 7/2008 Chung et al.

OTHER PUBLICATIONS

U.S. Appl. No. 12/020,373, filed Jan. 25, 2008, by Jing Jing Yu.
U.S. Appl. No. 11/716,788, filed Mar. 12, 2007, by Jing Jing Yu.
U.S. Appl. No. 11/860,298, filed Sep. 24, 2007, by Jing Jing Yu.
U.S. Appl. No. 12/172,228, filed Jul. 12, 2008, by Jing Jing Yu.
U.S. Appl. No. 12/098,423, filed Apr. 5, 2008, by Jing Jing Yu.
U.S. Appl. No. 61/043,262, filed Apr. 8, 2008, by Jing Jing Yu.
U.S. Appl. No. 60/949,804, filed Jul. 13, 2007, by Jing Jing Yu.
Non-Final Office Action mailed Jun. 14, 2007, in U.S. Appl. No. 11/350,343, filed Feb. 9, 2006, by Jing Jing Yu.
Non-Final Office Action mailed May 23, 2005, in U.S. Appl. No. 10/767,820, filed Jan. 30, 2004 by Minzhu Li.
Non-Final Office Action mailed Aug. 18, 2008, in U.S. Appl. No. 11/461,293, filed Jul. 31, 2006, by Jing Jing Yu.
Non-Final Office Action mailed May 16, 2008, in U.S. Appl. No. 11/461,293, filed Jul. 31, 2006, by Jing Jing Yu.
Non-Final Office Action mailed Dec. 21, 2007, in U.S. Appl. No. 11/461,293, filed Jul. 31, 2006, by Jing Jing Yu.
Non-Final Office Action mailed Jun. 4, 2007, in U.S. Appl. No. 11/189,066, filed Jul. 26, 2005, by Jing Jing Yu.
Non-Final Office Action mailed Oct. 27, 2008, in U.S. Appl. No. 11/849,939, filed Sep. 4, 2007, by Jing Jing Yu.
Final Office Action mailed Sep. 25, 2008, in U.S. Appl. No. 11/849,939, filed Sep. 4, 2007, by Jing Jing Yu.

Non-Final Office Action mailed Mar. 20, 2008, in U.S. Appl. No. 11/849,939, filed Sep. 4, 2007, by Jing Jing Yu.
Non-Final Office Action mailed Feb. 7, 2006, in U.S. Appl. No. 10/984,651, filed Nov. 10, 2004, by Jing Jing Yu.
Non-Final Office Action mailed Feb. 15, 2007, in U.S. Appl. No. 11/056,148, filed Feb. 14, 2005, by Jing Jing Yu.
U.S. Appl. No. 11/831,929, filed Jul. 31, 2007, by Jing Jing Yu.
"Holiday Lighting: Latest Technology Saves Time, Money and More," Burrelle's Yeadon Times, Yeadon, PA, Nov. 29, 2001.
"New kind of Christmas lights cut electricity use," Luce Press Clippings, Nevada Appeal, Carson City, NV, Dec. 2, 2001.
Christmas may be brighter longer, Huntsville Times, Huntsville, Alabama, Dec. 10, 2001.
"Holiday lights that stay ready for action," News Journal, Wilmington Metropolitan Area, Dec. 17, 2001.
"Bulbs that didn't work spur new line of lights," Richmond, Virginia, Times, Dec. 25, 2001.
"Now, let's eliminate tangles too," Sentinel-Tribune, Bowling Green, Ohio, Dec. 22, 2001.
"LED Christmas lights gaining in popularity," Luce Press, Shamokin, Pennsylvania, Dec. 2, 2001.
"It's beginning to look a lot light Christmas," Luce Press, Democrat, Tallahassee, Florida, Dec. 3, 2001.
"LED lights are Christmas option," Luce Press, Herald News, Joliet, Illinois, Nov. 28, 2001.
"A welcome idea for those who string holiday lights," Luce Press, Times, Seattle, Washington, Nov. 29, 2001.
"LEDing the way," Luce Press, Chronicle, Houston, Texas, Dec. 2, 2001.
"...Malfunctioning yule lights," Desert News, Salt Lake City-Ogden Metro Area, Utah, Dec. 9, 2001.
"LED holiday lights catch on," Luce Press, Herald, Sharon, Pennsylvania, Dec. 2, 2001.
"A brighter day for yule lights," Luce Press, Star, Kansas City, Missouri, Dec. 8, 2001.
"LED Lights Giving Off A Christmas Sparkle," "Entrepreneurs Claim LED Technology Better Than Christmas Bulbs," Luce Press, Tribune, Salt Lake City-Ogden, Utah, Dec. 2, 2001.
"New Christmas lights gaining popularity," Luce Press, Intelligencer, Doylestown, Pennsylvania, Nov. 28, 2001.
"Forever Bright," Luce Press, New Jersey Herald, Newton, New Jersey, Nov. 25, 2001.
"Replacements for traditional Christmas lights gaining popularity," Luce Press, Nov. 28, 2001.
"Inventor lights up Christmas," Luce Press, Valley News Dispatch, Tarentum, Pennsylvania, Nov. 25, 2001.
"The Christmas light man," Luce Press, Dominion Post, Morgantown, West Virginia, Nov. 24, 2001.
"LEDs the coolest thing in holiday lights," Luce Press, Press, Atlantic City, New Jersey, Nov. 25, 2001.
"Consumers switch to LED Christmas lights for their reliability," Luce Press, Star-Gazette, Elmira, New York, Dec. 2, 2001.
"All wrapped up," Luce Press, Ledger, Ellwood City, Pennsylvania, Dec. 1, 2001.
"Beating Christmas burnout," Luce Press, Press Enterprise, Bloomsburg, Pennsylvania, Nov. 26, 2001.
U.S. Appl. No. 09/339,616; Inventor: Tuyet Thi Vo; abandoned.
U.S. Appl. No. 09/378,631, Inventor: Tuyet Thi Vo; abandoned.

* cited by examiner

WATER-RESISTANT AND REPLACEABLE LED LAMPS

CROSS REFERENCE TO RELATED APPLICATION

This application is based upon and claims the benefit of U.S. provisional application No. 61/043,262, entitled "WATER-RESISTANT AND REPLACEABLE LED LAMPS," filed Apr. 8, 2008, the entire disclosure of which is herein specifically incorporated by reference for all that it discloses and teaches.

BACKGROUND OF THE INVENTION

Light emitting diodes (LEDs), as an alternative light source to the traditional incandescent and fluorescent lamps, have been widely implemented. For example, one common use for LED lights is for decorative lighting strings. The wide use of LEDs is the result of the high power efficiency, long lifetime and low cost of LED elements. Decorative light strings using LEDs are used for both interior and exterior applications. The moisture exposure resulting from outdoor use, such as from rain, snow, as well as other airborne contaminants, shorten the lifetime of lighting strings. Water-resistant lamp assemblies for use in LED lighting strings is necessary, not only for extended use of the LED string, but also for safety reasons.

SUMMARY OF THE INVENTION

One embodiment of the present invention may therefore comprise a waterproof lamp assembly for use in an LED light string comprising: wires that are connected to the light string; a lamp holder that is overmolded around the wires, said lamp holder having a central opening that has a specified shape; a pair of connectors that extend outwardly from the lamp holder adjacent to the central opening so that the lamp holder can be overmolded around lower portions of the connectors without covering extended portions of the connectors that extend beyond the lamp holder, the connectors made from a malleable material so that the connectors can be bent and folded into the central opening of the lamp holder; a snap ring disposed around a peripheral portion of the lamp holder; a lamp holder cover having a first opening and a second opening at opposite ends of the lamp holder cover; a snap recess disposed in the second opening that engages the snap ring to create a watertight seal between the lamp holder cover and the lamp holder; a socket having an extended portion, the extended portion having a shape that substantially matches said specified shape of the central opening of the lamp holder; an LED element having LED leads that extend through openings in the socket and wrap around the extended portion of the socket so that the LED leads abut against the connectors when the connectors are folded into the central opening of the lamp holder and the extended portion of the socket is inserted in the central opening of the lamp holder, the socket extending through the lamp holder so that the LED element extends outwardly from the first opening of the lamp holder; a lamp cover having a base that fits into the first opening of the lamp holder cover and provides a watertight seal between the lamp cover and the lamp holder cover.

An embodiment of the present invention may further comprise a waterproof lamp assembly for use in a light string comprising: a lamp cover; a lamp cover base attached to the lamp cover; a socket having internal openings and an extended portion; an LED element having LED leads that extend through the internal openings in the socket and are folded around an exterior surface of the extended portion of the socket, the extended portion having a predetermined shape; wires connected to the light string; a lamp holder that is overmolded around the wires to prevent moisture from entering the lamp holder, the lamp holder having a central opening that has a predetermined shape that substantially matches the predetermined shape of the extended portion of the socket; connectors having a lower portion that is overmolded in the lamp holder, and upper portions that extend outwardly from the lamp holder that are not overmolded, the connectors made from a malleable material and folded into the central opening of the lamp holder so that the LED leads disposed on the outer surface of the extended portion of the socket abut against the connectors and form an electrical connection when the socket is inserted into the central opening of the lamp holder.

An embodiment of the present invention may further comprise a method of providing a lamp assembly for an LED light string that is watertight and allows replacement of an LED element comprising: overmolding wires connected to the LED light string and lower portions of conductors attached to the wires to form a lamp holder having a central opening, the central opening having a predetermined shape; providing extended portions of the conductors that extend outwardly from the lamp holder that are not overmolded; folding the extended portions of the conductors into the central opening in the lamp holder; providing a snap ring around a peripheral portion of the lamp holder; forming a lamp holder cover having a first opening on a first end of the lamp holder cover, and a second opening that communicates with the first opening on a second end of the lamp holder cover; providing a snap recess in the second opening of the lamp holder cover that engages the snap ring of the lamp cover to form a watertight seal between the lamp holder cover and the lamp holder; providing a socket having an extended portion and openings formed in a central portion of the socket, the extended portion of the socket having a predetermined shape that substantially matches the predetermined shape of the central opening of the lamp holder; inserting LED leads connected to the LED element through the openings in the socket; folding the LED leads that extend beyond the extended portion of the socket around an outer peripheral portion of the extended portion of the socket; inserting the socket into the central opening of the lamp holder so that the LED leads abut against the connectors in the opening in the lamp holder to form an electrical contact; attaching a lamp cover to the first opening of the lamp holder.

An embodiment of the present invention may further comprise a method of providing a lamp assembly for an LED light string that is watertight and allows replacement of an LED element comprising: overmolding wires connected to the LED light string and lower portions of conductors attached to the wires to form a lamp holder having a central opening, the central opening having a predetermined shape; providing extended portions of the conductors that extend outwardly from the lamp holder that are not overmolded; folding the extended portions of the conductors into the central opening in the lamp holder; providing a socket having an extended portion and openings formed in a central portion of the socket, the extended portion of the socket having a predetermined shape that substantially matches the predetermined shape of the central opening of the lamp holder; inserting LED leads connected to the LED element through the openings in the socket; folding the LED leads that extend beyond the extended portion of the socket around an outer peripheral portion of the extended portion of the socket; inserting the socket into the central opening of the lamp holder so that the LED leads abut against the connectors in the opening in the lamp holder to form an electrical contact; attaching a lamp cover to the first opening of the lamp holder.

DETAILED DESCRIPTION OF THE EMBODIMENTS

Figure 1:
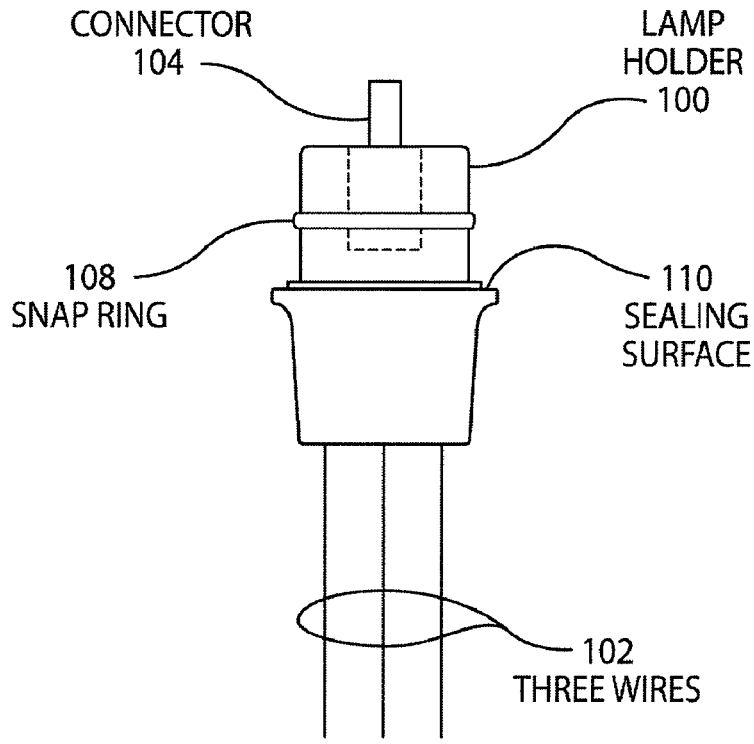
FIG. 1 is a side view of one embodiment of a lamp holder.

FIG. 1 is a side view of a lamp holder 100 that forms part of a lamp assembly for a waterproof lamp that uses replaceable LED elements. Many waterproof lamp assemblies are constructed as sealed units that use plastic injection molding to overmold the entire lamp assembly. This process provides water-resistance, but does not allow burned out LEDs to be replaced. In series wired LED strings, if one bulb is burned open, the remaining bulbs in the string will go dark. Parallel wiring techniques to overcome these problems are more complex and expensive to implement because of the additional wiring required. Further, light strings that use overmolding techniques often result in contact surfaces being coated with plastic material so that contact surfaces are not conductive and the light strings are faulty.

Figure 2:
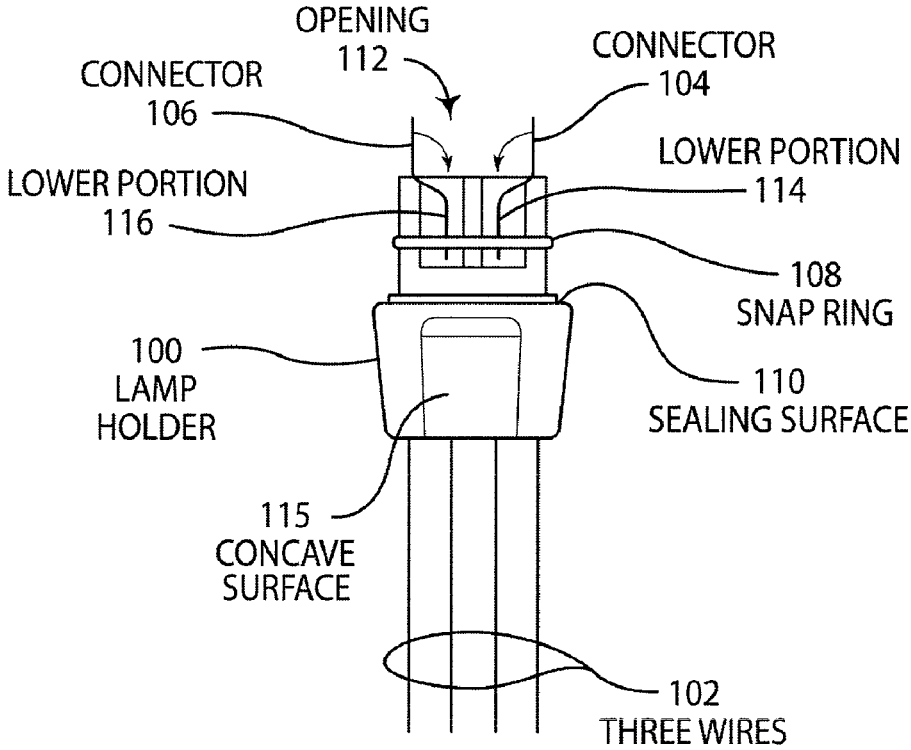
FIG. 2 is another side view of the lamp holder of FIG. 1.

Various approaches have been used to provide a replaceable bulb, especially in a waterproof package, such as disclosed in U.S. patent application Ser. No. 60/949,804, filed Jul. 13, 2007, by Jing Jing Yu, entitled "Watertight LED Lamp," and U.S. patent application Ser. No. 11/957,294, filed Dec. 14, 2007, by Jing Jing Yu, entitled "Substantially Inseparable LED Lamp Assembly," which are specifically incorporated herein by reference for all that they disclose and teach. The lamp holder 100, illustrated in FIG. 1, provides a different approach. As shown in FIGS. 1 and 2, lamp holder 100 includes connectors 104, 106 that are conductively connected to the three wires 102 at lower portions 114, 116, respectively. The connectors 104, 106 have an extended portion, that is illustrated in FIGS. 1 and 2, which are later bent into the opening 112 in the lamp holder 100. In this manner, the lamp holder 100 can be overmolded using plastic material with the extended portions of the connectors 104, 106 outside of the injection mold. Since the connectors 104, 106 extend upwardly away from the lamp holder 100, the injection molding process of overmolding the lamp holder 100 is simplified, and the connectors 104, 106 are outside of the injection mold. In this manner, plastic material does not cover the connectors 104, 106. The connectors 104, 106 have sufficient malleability to allow the connectors 104, 106 to be bent into the opening 112 without breaking and provide an electrical connection with an LED element as disclosed below. The overmolding provides a watertight seal between the lamp holder 100 and three wires 102, as well as other portions of the lamp holder 100. The lamp holder 100 also includes a snap ring 108 that engages a lamp holder cover 600, illustrated in FIGS. 6-9, which also seals the lamp holder 100 to the lamp holder cover at sealing surface 110, as disclosed below. Snap ring 108 can be a separate piece that is attached to lamp holder 100 or can be molded into the lamp holder 100 during the injection molding process. Concave surface 115 provides an indication of the polarity in which the lamp holder 100 is connected to the three wires 102. The three wires 102 are typically used in parallel wired configurations for LED light strings.

Figure 3:
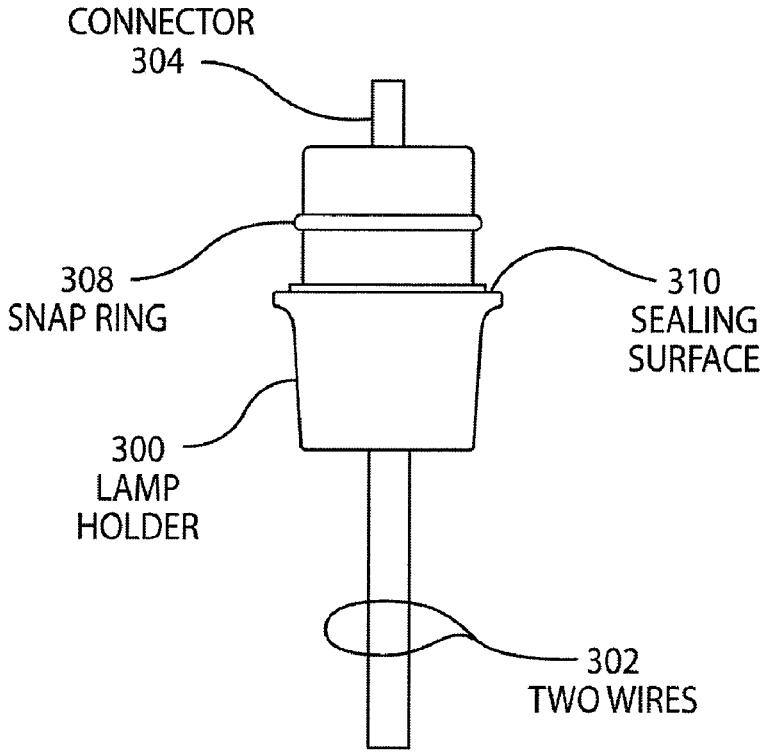
FIG. 3 is a side view of another embodiment of the lamp holder.
Figure 4:
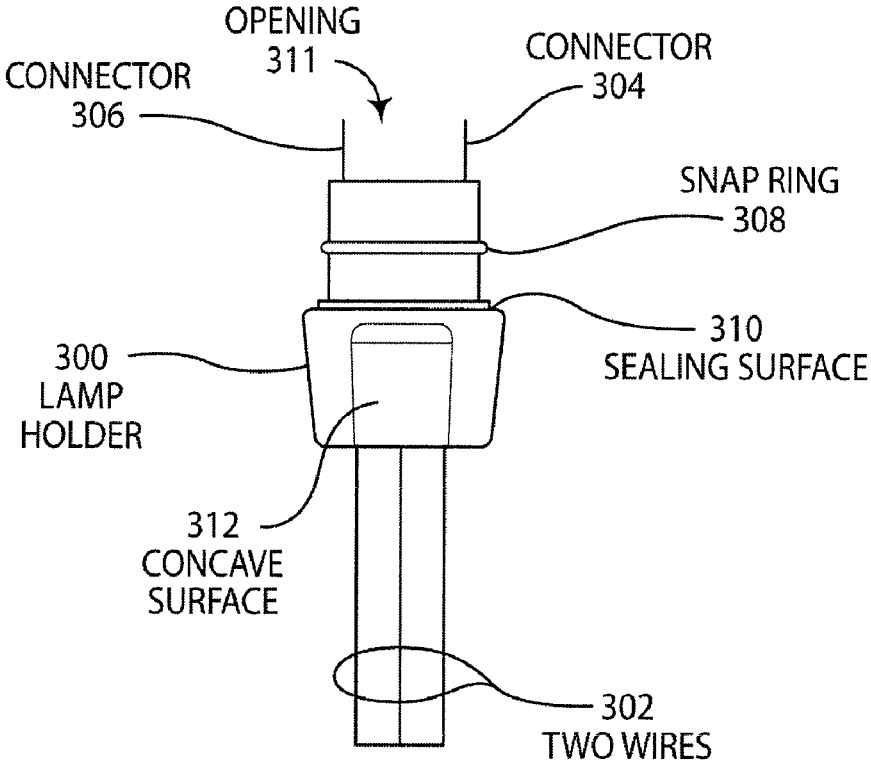
FIG. 4 is another side view of the embodiment of the lamp holder of FIG. 3.
Figure 5:
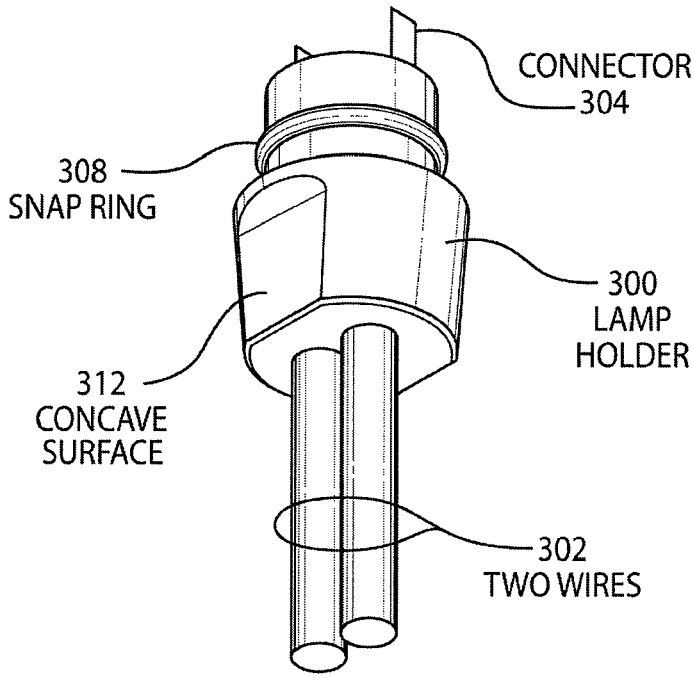
FIG. 5 is an isometric view of the lamp holder of FIG. 3.
Figure 6:
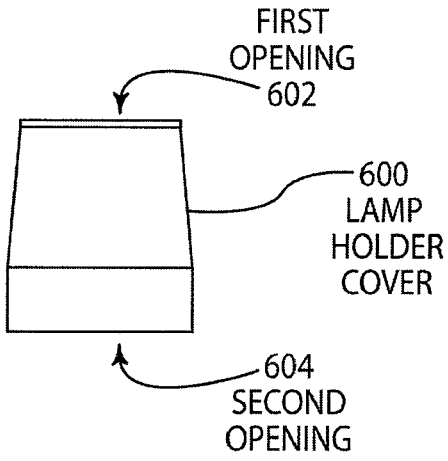
FIG. 6 is a side view of one embodiment of a lamp holder cover.
Figure 7:
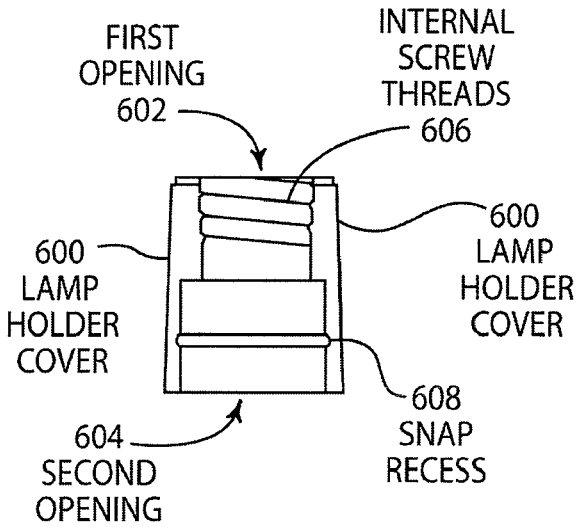
FIG. 7 is a cutaway view of the lamp holder cover of FIG. 6.
Figure 8:
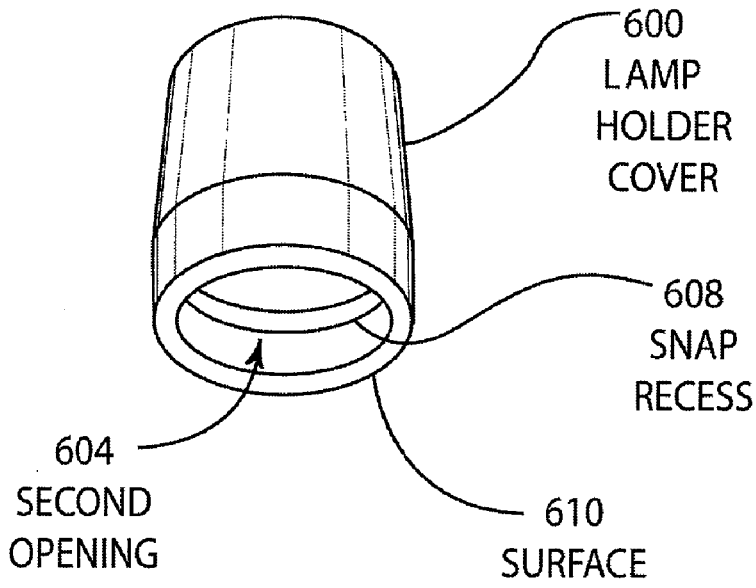
FIG. 8 is an isometric bottom view of the lamp holder cover of FIG. 6.
Figure 9:
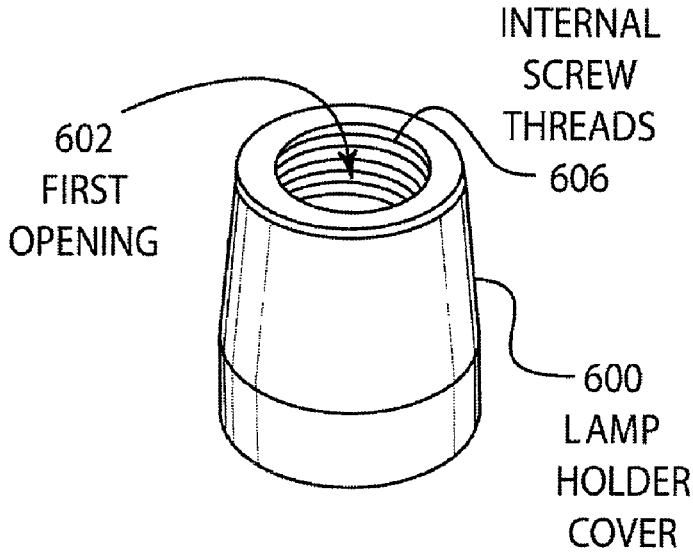
FIG. 9 is a top isometric view of the lamp holder cover of FIG. 6.

FIGS. 3-5 illustrate another embodiment of a lamp holder 300. As shown in FIGS. 3, 4 and 5, two wires 302 are connected to connectors 304, 306. Two wire connections are typically used in series wired configurations in LED light strings. Lamp holder 300 includes a snap ring 308 that connects to the lamp holder cover 600, illustrated in FIGS. 6-9. Again, snap ring 308 may be a separate piece or molded into lamp holder 300. The lamp holder cover 600 snaps onto the snap ring 308 and seals to the lamp holder 300 at sealing surface 310 and also around the snap ring 308. Connectors 304, 306 extend from the lamp holder 300 and allow the lamp holder to be easily overmolded without any plastic coating the connectors 304, 306. Connectors 304, 306 have sufficient malleability so that they can be bent into the opening 311 and provide an electrical connection with an LED element, such as LED element 1006 illustrated in FIG. 10. The concave surface 312 provides an indication of the polarity in which the lamp holder 300 is connected to the two wires 302.

FIGS. 6-9 illustrate an embodiment of a lamp holder cover 600 that can be connected to lamp holder 100 or lamp holder 300. As shown in FIGS. 6-9, lamp holder cover 600 includes a first opening 602 in a first end of the lamp holder cover 600, and a second opening 604 in a second end of the lamp holder cover 600. Lamp holder cover 600 includes internal screw threads 606 in the first opening 602 and a snap recess 608 in the second opening 604. The snap recess 608 is adapted to mate with snap ring 108 and snap ring 308 to attach and seal the lamp holder cover 600 to lamp holder 100 and lamp holder 300, respectfully. Snap recess can be machined into lamp holder cover 600, or can be molded into the lamp holder cover 600 as part of the injection molding process. Surface 610, adjacent second opening 604, abuts against sealing surfaces 110, 310 of lamp holders 100, 300, respectfully, to provide additional sealing. Both the snap recess 608 and the snap rings 108, 308 provide a watertight seal between the lamp holders 100, 300 and the lamp holder cover 600, as well as the abutment of surface 610 with sealing surfaces 110, 310 of lamp holders 100, 300, respectfully.

Figure 10:
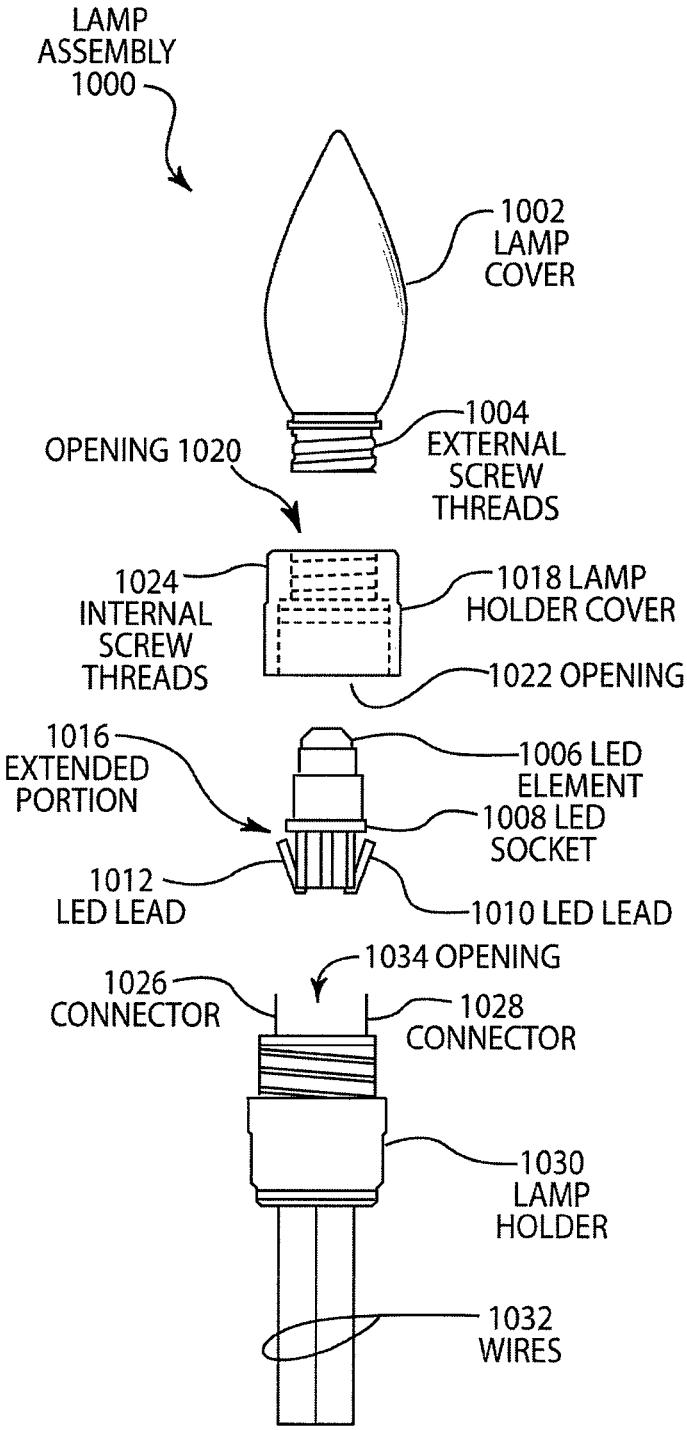
FIG. 10 is an assembly view of a lamp assembly.
Figure 11:
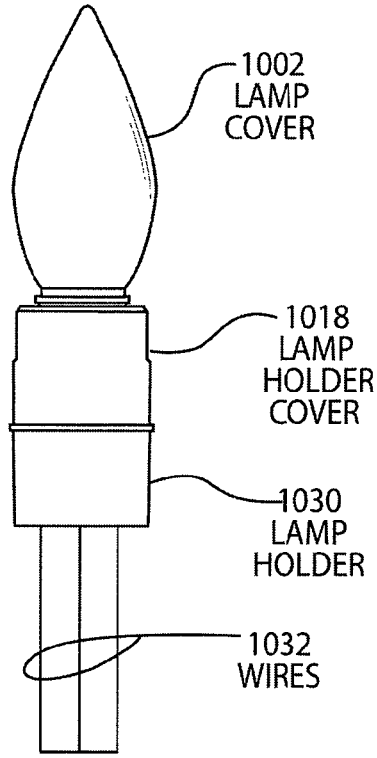
FIG. 11 is an assembled view of the lamp assembly of the lamp assembly of FIG. 10.

FIG. 10 is an assembly drawing of another embodiment of a lamp assembly 1000. As shown in FIG. 10, lamp cover 1002 has external screw threads 1004. External screw threads 1004 mate with internal screw threads 1024 of lamp holder cover 1018. As further shown in FIG. 10, LED element 1006 is connected to an LED socket 1008, such as disclosed in U.S. patent application Ser. No. 12/020,373, filed Jan. 25, 2008 by Jing Jing Yu, entitled "Removable LED Lamp Holder," and U.S. patent application Ser. No. 12/099,034, filed Apr. 7, 2008, by Jing Jing Yu and Sheng Wang Du entitled "Removable LED Lamp Holder With Socket" which are both specifically incorporated herein by reference for all that they disclose and teach. The combined LED element 1006 and LED socket 1008 are adapted to extend through first opening 1020 in the lamp holder cover 1018 so that the LED element 1006 projects light through the lamp cover 1002. In addition, the bottom portion of the LED socket 1008 extends through second opening 1022 of lamp holder cover 1018 into the opening 1034 of lamp holder 1030 after the connectors 1026, 1028 are bent into the opening 1034. LED leads 1010, 1012 abut against the connectors 1026, 1028, respectfully, to form an electrical contact. The extended portion 1016 of the socket 1008 has a size that forces the LED leads outwardly against connectors 1026, 1028 that are folded into the central opening of the lamp holder. In addition, the metal of connectors 1026, 1028, as well as the metal of LED leads 1010, 1012, although they are sufficiently malleable, have a modulus of elasticity that is sufficient to ensure that abutment occurs and a sufficient electrical contact is formed between the leads and the connectors. The same is true for the other connectors disclosed in the other embodiments set forth herein. Also, the interior walls of the lamp holder force the connectors against the LED leads, while the extended portion 1016 forces the LED leads against the connectors. In this fashion, a strong electrical connection is established. Connectors 1026, 1028 are connected to a power source by the wires 1032. Lamp holder cover 1018 is then screwed fit onto the lamp holder 1030 to provide a watertight sealed unit. The watertight sealed unit is illustrated in FIG. 11. Alternatively, a water tight snap fit can be used between lamp holder cover 1018 and lamp holder 1030.

As illustrated in FIGS. 10 and 11, the lamp assembly 1000 can be easily disassembled to replace the LED element 1006. The LED element 1006 can be disconnected from the LED socket 1008 and replaced, as described in the above referenced patent application entitled "Removable LED Lamp Holder," and the above referenced U.S. Patent Application entitled "Removable LED Lamp Holder With Socket," as well as U.S. Patent Application Ser. No. 60/949,804, filed Jul. 31, 2007, by Jing Jing Yu, entitled "Watertight LED Lamp," which is specifically incorporated herein by reference for all that it discloses and teaches. Alternatively, LED elements can be integrally mounted the socket for replacement as a single unit. Of course, the LED socket 1008 has a specific shape that mates with the opening 1034 in lamp holder 1030 so that the correct polarity of the LED element is maintained during assembly. In addition, whereas FIGS. 10 and 11 are illustrated with respect to the embodiments illustrated in FIGS. 1 and 2, the embodiments of FIGS. 3 and 4 can be similarly employed in the manner illustrated in FIGS. 10 and 11.

Figure 12:
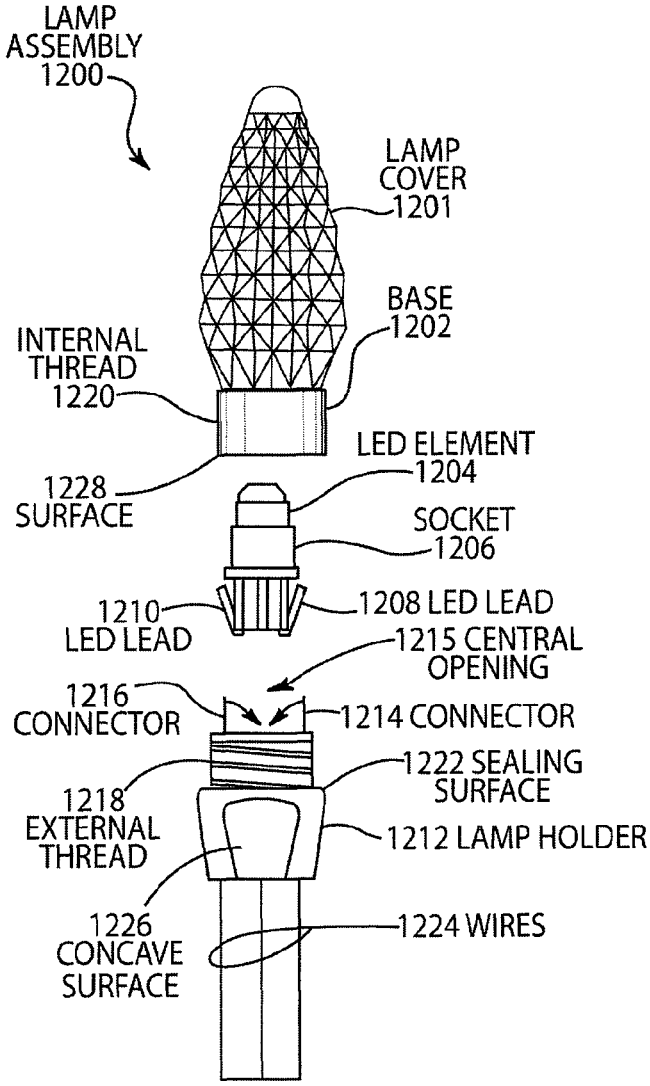
FIG. 12 is an assembly view of another embodiment of a lamp assembly.
Figure 13:
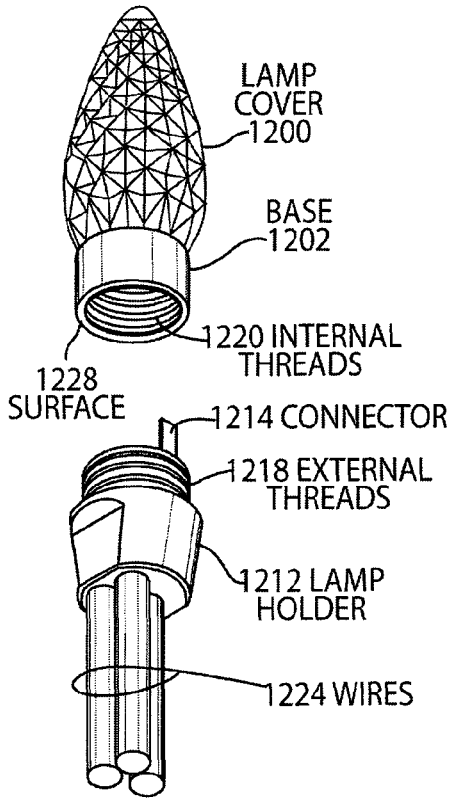
FIG. 13 is an isometric view of the embodiment of FIG. 12.

FIGS. 12 and 13 illustrate another embodiment of the lamp assembly 1200. As shown in FIGS. 12 and 13, lamp assembly 1200 includes a lamp cover 1201 having a base 1202 that has internal threads 1220. Surface 1228 is disposed along the bottom portion of the base 1202. LED element 1204 is coupled to socket 1206. Socket 1206 may have openings that allow LED leads 1208, 1210 to extend through the socket and wrap around an external extended portion of the socket 1206, as illustrated in FIG. 12. Lamp holder 1212 is overmolded around wires 1224 and around lower portion of connectors 1214, 1216. Connectors 1214, 1216 extend outwardly from the lamp holder 1212 and are not overmolded on the extended portions that are illustrated in FIG. 12. Connectors 1214, 1216 are made from a malleable material so that connectors 1214, 1216 can be folded into a central opening 1215 in lamp holder 1212. The metal of connectors 1214, 1216, also has a modulus of elasticity that is sufficient to ensure that the connectors 1214, 1216 abut against LED leads 1208, 1210. LED leads 1208, 1210 are also sufficiently malleable to wrap around the outside of socket 1206 while having sufficient elasticity to ensure that the LEDs abut against the connectors to form a strong electrical connection. For example, both the connectors and the LED leads can be mixed with a ferrous material to form an alloy to increase the elasticity of the metal used in the connectors and the LED leads. The amount of carbon included in the ferrous metal determines the elasticity and resistance to bending. However, an increase in elasticity also increases the resistance of these materials. In that regard, both the connectors and the LED leads can be coated with a substantially pure copper layer to increase the electrical conductivity between the connectors and the LED leads. Lamp holder 1212 also includes external threads 1218 and a sealing surface 1222. Surface 1228 abuts against surface 1222 to form a watertight seal when the internal threads 1220 of the base 1202 are threaded with the external threats 1218 of the lamp holder 1212. The abutment of surface 1228 with sealing surface 1222 provides a watertight seal, together with the interlocking thread of the internal thread 1220 and the external thread 1218. Concave surface 1226 provides a visual indication of the polarity in which the lamp holder 1212 is connected to wires 1224.

Hence, the embodiments disclose a waterproof lamp assembly that allows quick and easy replacement of LED elements. The waterproof lamp assembly allows the assembly to be used on light strings for both interior and exterior use on a prolonged basis. The lamp assembly can be easily assembled and disassembled for easy replacement of burned out LED elements. In addition, contacts that extend beyond the lamp holder are not subject to being coated by plastic during a plastic injection overmolding process of forming the lamp holder. Reliability and ease of manufacturing reduces costs and allows greater reliability in the operation of the lamp holder.

Variations of the methods of attachment of the lamp holder cover and lamp cover of the embodiments are disclosed above, can be used. For example, either an internal or external screw thread on the lamp holders 100, 300 can be used to attach the lamp holder cover. Similarly, friction-fit techniques and other techniques, including the snap ring and snap recess releasable attachment techniques, can also be used for attaching the lamp holders and lamp holder covers. Further, any of these techniques can be used to connect the lamp cover with the lamp holder of the embodiments of FIGS. 1-11. Similarly, any of these techniques can be used to attach the lamp cover 1201 to the lamp holder 1212.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A waterproof lamp assembly for use in an LED light string comprising:

wires that are connected to said light string;

a lamp holder that is overmolded around said wires, said lamp holder having a central opening that has a specified shape;

a pair of connectors that extend outwardly from said lamp holder adjacent to said central opening so that said lamp holder can be overmolded around lower portions of said connectors without covering extended portions of said connectors that extend beyond said lamp holder, said connectors made from a malleable material so that said connectors can be bent and folded into said central opening of said lamp holder;

a snap ring disposed around a peripheral portion of said lamp holder;

a lamp holder cover having a first opening and a second opening at opposite ends of said lamp holder cover;

a snap recess disposed in said second opening that engages said snap ring to create a watertight seal between said lamp holder cover and said lamp holder;

a socket having an extended portion, said extended portion having a shape that substantially matches said specified shape of said central opening of said lamp holder;

an LED element having LED leads that extend through openings in said socket and wrap around said extended portion of said socket so that said LED leads abut against said connectors when said connectors are folded into said central opening of said lamp holder and said extended portion of said socket is inserted in said central opening of said lamp holder, said socket extending through said lamp holder so that said LED element extends outwardly from said first opening of said lamp holder;

a lamp cover having a base that fits into said first opening of said lamp holder cover and provides a watertight seal between said lamp cover and said lamp holder cover.

2. The lamp assembly of claim 1 further comprising:

external screw threads disposed on said base of said lamp cover;

internal screw threads disposed in said first opening of said lamp holder cover that substantially match said external screw threads disposed on said base of said lamp cover.

3. A waterproof lamp assembly for use in a light string comprising:

a lamp cover;

a lamp cover base attached to said lamp cover;

a socket having internal openings and an extended portion;

an LED element having LED leads that extend through said internal openings in said socket and are folded around an exterior surface of said extended portion of said socket, said extended portion having a predetermined shape;

wires connected to said light string;

a lamp holder that is overmolded around said wires to prevent moisture from entering said lamp holder, said lamp holder having a central opening that has a predetermined shape that substantially matches said predetermined shape of said extended portion of said socket;

connectors having a lower portion that is overmolded in said lamp holder, and upper portions that extend outwardly from said lamp holder that are not overmolded, said connectors made from a malleable material and folded into said central opening of said lamp holder so that said LED leads disposed on said outer surface of said extended portion of said socket abut against said connectors and form an electrical connection when said socket is inserted into said central opening of said lamp holder.

4. The lamp assembly of claim 3 further comprising:

a sealing surface disposed around said lamp holder that engages a surface of said base of said lamp cover to provide a watertight seal.

5. The lamp assembly of claim 4 further comprising:

internal threads disposed on an interior portion of said lamp base;

external threads disposed on an extended portion of said lamp holder that substantially match said internal threads.

6. A method of providing a lamp assembly for an LED light string that is watertight and allows replacement of an LED element comprising:

overmolding wires connected to said LED light string and lower portions of conductors attached to said wires to form a lamp holder having a central opening, said central opening having a predetermined shape;

providing extended portions of said conductors that extend outwardly from said lamp holder that are not overmolded;

folding said extended portions of said conductors into said central opening in said lamp holder;

providing a snap ring around a peripheral portion of said lamp holder;

forming a lamp holder cover having a first opening on a first end of said lamp holder cover, and a second opening that communicates with said first opening on a second end of said lamp holder cover;

providing a snap recess in said second opening of said lamp holder cover that engages said snap ring of said lamp cover to form a watertight seal between said lamp holder cover and said lamp holder;

providing a socket having an extended portion and openings formed in a central portion of said socket, said extended portion of said socket having a predetermined shape that substantially matches said predetermined shape of said central opening of said lamp holder;

inserting LED leads connected to said LED element through said openings in said socket;

folding said LED leads that extend beyond said extended portion of said socket around an outer peripheral portion of said extended portion of said socket;

inserting said socket into said central opening of said lamp holder so that said LED leads abut against said connectors in said opening in said lamp holder to form an electrical contact;

attaching a lamp cover to said first opening of said lamp holder.

7. The method of claim 6 wherein said process of attaching said lamp cover to said lamp holder cover comprises:

screwing external threads formed on said lamp cover into internal threads formed in said lamp holder cover.

8. A method of providing a lamp assembly for an LED light string that is watertight and allows replacement of an LED element comprising:

overmolding wires connected to said LED light string and lower portions of conductors attached to said wires to form a lamp holder having a central opening, said central opening having a predetermined shape;

providing extended portions of said conductors that extend outwardly from said lamp holder that are not overmolded;

folding said extended portions of said conductors into said central opening in said lamp holder;

providing a socket having an extended portion and openings formed in a central portion of said socket, said extended portion of said socket having a predetermined shape that substantially matches said predetermined shape of said central opening of said lamp holder;

inserting LED leads connected to said LED element through said openings in said socket;

folding said LED leads that extend beyond said extended portion of said socket around an outer peripheral portion of said extended portion of said socket;

inserting said socket into said central opening of said lamp holder so that said LED leads abut against said connectors in said opening in said lamp holder to form an electrical contact;

attaching a lamp cover to said first opening of said lamp holder.

9. The method of claim 8 wherein said process of attaching said lamp cover to said lamp holder comprises:

screwing internal threads formed on said lamp cover onto external threads formed in said lamp holder.

* * * * *